US007217179B2

(12) United States Patent
Sakurai et al.

(10) Patent No.: US 7,217,179 B2
(45) Date of Patent: May 15, 2007

(54) POLISHING PAD

(75) Inventors: Fujio Sakurai, Chuo-ku (JP); Tomoo Koumura, Chuo-ku (JP); Yoshinori Igarashi, Chuo-ku (JP)

(73) Assignee: JSR Corporation, Tokyo (JP)

( * ) Notice: Subject to any disclaimer, the term of this patent is extended or adjusted under 35 U.S.C. 154(b) by 87 days.

(21) Appl. No.: 11/246,199

(22) Filed: Oct. 11, 2005

(65) Prior Publication Data

US 2006/0084365 A1 Apr. 20, 2006

(30) Foreign Application Priority Data

Oct. 14, 2004 (JP) ..... 2004-299522

(51) Int. Cl.
*B24D 11/00* (2006.01)

(52) U.S. Cl. ..... 451/526; 451/533; 51/298

(58) Field of Classification Search ..... 451/41, 451/526, 533; 51/298
See application file for complete search history.

(56) References Cited

U.S. PATENT DOCUMENTS

| | | | | |
|---|---|---|---|---|
| 6,293,852 | B1 | 9/2001 | Roberts et al. | |
| 6,337,280 | B1 | 1/2002 | Yano | |
| 6,454,634 | B1 | 9/2002 | James et al. | |
| 6,790,883 | B2 | 9/2004 | Ogawa et al. | |
| 6,979,701 | B2 * | 12/2005 | Kaneda et al. | 521/170 |
| 2004/0055223 | A1 * | 3/2004 | Ono et al. | 51/293 |
| 2005/0064709 | A1 * | 3/2005 | Shimomura et al. | 438/689 |
| 2006/0148393 | A1 * | 7/2006 | Ono et al. | 451/526 |

FOREIGN PATENT DOCUMENTS

| | | |
|---|---|---|
| JP | 8-500622 | 1/1996 |
| JP | 2000-33552 | 2/2000 |
| JP | 2000-34416 | 2/2000 |
| JP | 2001-334455 | 12/2001 |
| WO | WO 94/04599 | 3/1994 |
| WO | WO 2004/024393 A1 | 3/2004 |

* cited by examiner

*Primary Examiner*—Eileen P. Morgan
(74) *Attorney, Agent, or Firm*—Oblon, Spivak, McClelland, Maier & Neustadt, P.C.

(57) ABSTRACT

A polishing pad having a polishing layer which has specific composition and a ratio of the storage elastic modulus at 30° C. to the storage elastic modulus at 60° C. of 2 to 15 and a ratio of the storage elastic modulus at 30° C. to the storage elastic modulus at 90° C. of 4 to 20 and is made of a polyurethane or polyurethane-urea. This polishing pad suppresses the scratching of the surface to be polished and planarizes the surface efficiently. A polishing pad having a polishing layer containing water-soluble particles can achieve a higher removal rate.

11 Claims, No Drawings

POLISHING PAD

FIELD OF THE INVENTION

The present invention relates to a polishing pad. More specifically, it relates to a polishing pad which has a polishing layer made of a polyurethane or polyurethane-urea having specific composition and is capable of easing damage to a surface to be polished by foreign matter as the polishing layer suitably softens at a high temperature under extreme polishing conditions. This pad can be advantageously used to polish the surface of a semiconductor wafer or the like.

DESCRIPTION OF THE PRIOR ART

Chemical mechanical polishing (CMP) is attracting much attention as a polishing technique capable of forming an extremely flat surface. CMP is carried out by letting slurry as an aqueous dispersion of abrasive grains flow down over the surface of a polishing pad from above while the polishing pad and the surface to be polished are brought into slide contact with each other. It is proposed to suppress fluctuations in the elastic modulus of the polishing pad by temperature variations in order to suppress fluctuations in polishing performance caused by the increasing temperature of the surface of the polishing pad due to frictional heat generated by the polishing of the surface (refer to U.S. Pat. No. 6,293,852 and U.S. Pat. No. 6,454,634). However, as the elastic modulus of the polishing pad is too high under extreme polishing conditions such as high polishing pressure or high revolution under which the surface to be polished is readily scratched by foreign matter such as powders generated by polishing and an agglomerate of abrasive grains contained in the slurry, it is difficult to ease damage to the surface by the foreign matter.

The removal rate is one of the factors of greatly affecting the productivity of CMP. It is said that the removal rate can be greatly improved by increasing the amount of slurry held on the polishing pad. Heretofore, polishing has been carried out by using polyurethane foam containing tiny cells as a polishing pad for CMP and holding slurry in holes (to be referred to as "pores" hereinafter) open to the surface of this resin foam.

However, it is difficult to freely control foaming for the polyurethane foam, and it is also extremely difficult to control the sizes and density of pores uniformly over the whole area of the foam. As a result, this causes variations in the quality, removal rate and processing state of the polishing pad composed of polyurethane foam.

Polishing pads obtained by dispersing a soluble product in a resin are known as polishing pads capable of controlling pores by foaming easily (JP-A 8-500622, JP-A 2000-33552, JP-A 2000-34416 and JP-A 2001-334455) (the term "JP-A" as used herein means an "unexamined published Japanese patent application"). Out of these, JP-A 8-500622 and JP-A 2000-33552 suggest the effectiveness of the polishing pads containing a soluble product. However, no studies are made on a matrix when these polishing pads are actually used.

In JP-A 2000-34416 and JP-A 2001-334455, studies are made on the constituent materials of the polishing pads, and stable polishing and the improvement of the removal rate are observed. However, more stable polishing and the further improvement of the retainability of slurry and the removal rate are required for the actual polishing work.

It is also necessary to further improve the planarity of the polished object.

SUMMARY OF THE INVENTION

The present invention has been made in view of the above situation. It is therefore an object of the present invention to provide a polishing pad which rarely causes scratching under extreme polishing conditions under which damage to the surface to be polished by foreign matter becomes a problem as the elastic modulus of a polishing layer tends to drop suitably upon a rise in temperature, has excellent polishing stability, slurry retainability and a high removal rate, and is excellent in the planarization of an object to be polished.

Other objects and advantages of the present invention will become obvious from the following description.

According to the present invention, firstly, the above objects and advantages of the present invention are attained by a polishing pad having a polishing layer made of a polyurethane or polyurethane-urea, wherein the polyurethane or polyurethane-urea is a cured reaction product of a mixture of an isocyanate-terminated urethane prepolymer A and a chain extender B which has two or more active hydrogen-containing groups capable of reacting with an isocyanate group in the molecule and satisfies the following conditions "a" and "b":

a. the chain extender consists of 50 to 100 wt % of a chain extender having a number average molecular weight of 300 or less and 50 to 0 wt % of a chain extender having a number average molecular weight higher than 300, or
b. the chain extender consists of 20 to 100 wt % of a chain extender having three or more active hydrogen-containing groups in the molecule and 80 to 0 wt % of a chain extender having two active hydrogen-containing groups in the molecule; and the ratio of the storage elastic modulus at 30° C. to the storage elastic modulus at 60° C. of the polishing pad is 2 to 15, and the ratio of the storage elastic modulus at 30° C. to the storage elastic modulus at 90° C. of the polishing pad is 4 to 20.

According to the present invention, secondly, the above objects and advantages of the present invention are attained by a polishing pad having a polishing layer containing water-soluble particles dispersed in a polymer matrix made of a polyurethane or polyurethane-urea.

DETAILED DESCRIPTION OF THE PREFERRED EMBODIMENTS

The present invention will be described in detail hereinunder.

It is important that the polishing pad should polish a projection on the surface to be polished of an object first and rarely polish a recess on the surface and that the entire surface at the end of polishing should become smooth. Therefore, the polishing pad is desired to have relatively high hardness so that the surface of the polishing pad does not transform and enter a recess on the surface to be polished. Meanwhile, when the polishing pad has high hardness, it is inferior in transformability, whereby damage (scratches) to the surface to be polished by foreign matter such as powders generated by polishing and an agglomerate of abrasive grains contained in slurry increases, thereby reducing the yield of accepted products. With the polishing pad of the prior art, it is difficult to achieve high planarizability and the suppression of scratching at the same time. The polishing layer of the polishing pad of the present invention is made of a polyurethane or polyurethane-urea obtained by reacting an isocyanate-terminated urethane prepolymer with a chain extender as a polymer matrix. Use of a component having a number average molecular weight of 300 or less and a component containing three or more active hydrogen-containing groups in the molecular in a certain ratio in the chain extender as a raw material makes it possible to reduce the storage elastic modulus of the polymer matrix to an appropriate value at a high temperature. Due to the suitable temperature-dependent change of the storage elastic modulus, the polymer matrix easily and quickly softens and transforms by heat generated when the polishing layer is rubbed violently by foreign matter, thereby making it possible to suppress damage to the surface to be polished by the foreign matter. Therefore, the polishing layer of the present invention is excellent in the effect of suppressing scratching (improvement of yield). Since the polishing layer of a portion not in contact with the foreign matter has a relatively low temperature, the polymer matrix is hard and therefore, the planarizability of an object to be polished becomes high.

It is preferred for the polishing pad that pores having the function of holding slurry during polishing and the function of temporarily retaining powders generated by polishing should be formed by the time of polishing. A polishing pad according to another embodiment of the present invention has a polishing layer comprising a polymer matrix, which is a polyurethane or polyurethane-urea and has the above elastic modulus change characteristics, and water-soluble particles dispersed in the polymer matrix. The water-soluble particles dissolve in water or swell with water to be eliminated upon their contact with slurry containing a medium and a solid during polishing, thereby forming pores. A polishing pad having high hardness, large compressive strength and the excellent planarizability of an object to be polished can be obtained because pores having excellent uniformity in size suitable for holding slurry are formed in the surface layer of the pad for holding slurry required for polishing due to the above structure, and the inside of the pad has a non-porous structure in which the water-soluble particles are existent. Since the polymer matrix having excellent breaking strength and abrasion resistance is obtained in the present invention, the transformation and abrasion of the surface of the pad by external force such as pressure applied to the polishing pad from the object to be polished during polishing and dressing with a diamond dresser can be suppressed, thereby making it possible to obtain a polishing pad having excellent polishing stability and slurry retainability and a high removal rate.

Isocyanate-Terminated Urethane Prepolymer A

The isocyanate-terminated urethane prepolymer A used in the present invention is obtained by reacting a compound Y having two or more OH groups in the molecule with a polyisocyanate having two or more isocyanate groups in the molecule in an isocyanate group/OH group equivalent ratio of preferably 2 or more, more preferably 2 to 5, most preferably 2.1 to 4. When the equivalent ratio becomes lower than 2, the molecular weight of the obtained isocyanate-terminated urethane prepolymer becomes high with a result of a rise in the viscosity of the isocyanate-terminated urethane prepolymer. Therefore, the heating temperature must be further increased. This makes it difficult to control conditions for molding the polyurethane matrix, whereby the performance of the obtained polishing pad becomes unstable. When the equivalent ratio becomes higher than 5, a reduction in the elastic modulus of the obtained polymer matrix upon a rise in temperature becomes excessive, whereby fluctuations in the polishing performance of the polishing pad become large, thereby making polishing unstable disadvantageously.

Although the obtained isocyanate-terminated urethane prepolymer A is essentially composed of an isocyanate-terminated urethane prepolymer, it may contain an unreacted raw material such as the compound Y having two or more OH groups in the molecule or the polyisocyanate having two or more isocyanate groups in the molecule.

For the synthesis of the isocyanate-terminated urethane prepolymer A, the temperature may be raised to 50 to 90° C., or a metal-based catalyst such as a tertiary amine or organic tin may be optionally used as a reaction catalyst. Examples of the compound Y having two or more OH groups in the molecule include diol compounds having OH groups at both terminals of one molecule, polyfunctional polyols having three or more OH groups in one molecule and polyfunctional low molecular weight alcohols having two or more OH groups in one molecule.

The diol compounds having two OH groups at both terminals of one molecule include polyether diols such as aliphatic polyether diols, alicyclic polyether diols and aromatic polyether diols, polyester diols, polycarbonate diols, polycaprolactone diols, polyols synthesized from a reaction between a diol and a polyisocyanate, and other polyols. These polyols may be used alone or in combination of two or more.

The aliphatic polyether diols include polyethylene glycol, polypropylene glycol, polytetramethylene glycol, polyhexamethylene glycol, polyheptamethylene glycol, polydecamethylene glycol and polyether diols obtained by the ring opening copolymerization of two or more ion polymerizable cyclic compounds.

Examples of the above ion polymerizable cyclic compounds include ethylene oxide, propylene oxide, butene-1-oxide, isobutene oxide, 3,3-bischloromethyloxetane, tetrahydrofuran, 2-methyltetrahydrofuran, 3-methyltetrahydrofuran, dioxane, trioxane, tetraoxane, cyclohexene oxide, styrene oxide, epichlorohydrin, glycidyl methacrylate, allyl glycidyl ether, allyl glycidyl carbonate, butadiene monoxide, isoprene monooxide, vinyl oxetane, vinyl tetrahydrofuran, vinyl cyclohexene oxide, and cyclic ethers such as phenyl glycidyl ether, butyl glycidyl ether and glycidyl benzoate.

The polyether diols obtained by the ring opening copolymerization of two or more ion polymerizable cyclic compounds include copolymer diols obtained from a combination of tetrahydrofuran and propylene oxide, a combination of tetrahydrofuran and 2-methyltetrahydrofuran, a combination of tetrahydrofuran and 3-methyltetrahydrofuran, a combination of tetrahydrofuran and ethylene oxide, a combination of propylene oxide and ethylene oxide and a combination of butene-1-oxide and ethylene oxide; and terpolymer diols obtained from a combination of tetrahydrofuran, butene-1-oxide and ethylene oxide.

Polyether diols obtained by the ring opening copolymerization of the above ion polymerizable cyclic compound and a cyclic imine such as ethylene imine, cyclic lactonic acid such as β-propiolactone or lactide glycolate, or dimethylcyclopolysiloxane may also be used. Commercially available products of the above aliphatic polyether diols include PTMG650, PTMG1000 and PTMG2000 (of Mitsubishi Chemical Corporation), P400 and P1000 (of Asahi Denka Co., Ltd.), Exenol 720, 1020 and 2020 (of Asahi Glass Urethane Co., Ltd.), PEG1000, Unisafe DC1100 and DC1800 (of NOF Corporation), PTG2000, PTG1000, PTG400 and PTGL2000 (of Hodogaya Chemical Co., Ltd.), Z-3001-4, Z-3001-5, PBG2000A, PBG2000B, EO/BO4000 and EO/BO2000 (of Dai-Ichi Kogyo Seiyaku Co., Ltd.), and Poly THF 250, Poly THF 650, Poly THF 1000, Poly THF 1800 and Poly THF 2000 (of BASF Japan Co., Ltd.).

The alicyclic polyether diols include alkylene oxide added diols of hydrogenated bisphenol A, alkylene oxide added diols of hydrogenated bisphenol F and alkylene oxide added diols of 1,4-cyclohexanediol. Further, the aromatic polyether diols include alkylene oxide added diols of bisphenol A, alkylene oxide added diols of bisphenol F, alkylene oxide added diols of hydroquinone, alkylene oxide added diols of naphthohydroquinone and alkylene oxide added diols of anthrahydroquinone. Commercially available products of the above aromatic polyether diols include Uniol DA400, DA700, DA1000 and DA4000 (of NOF Corporation).

The polyester diols are obtained by reacting a polyhydric alcohol with a polybasic acid. Examples of the polyhydric alcohol include ethylene glycol, polyethylene glycol, propylene glycol, polypropylene glycol, tetramethylene glycol, polytetramethylene glycol, 1,6-hexanediol, neopentyl glycol, 1,4-cyclohexanedimethanol, 3-methyl-1,5-pentanediol, 1,9-nonanediol and 2-methyl-1,8-octanediol. Examples of the polybasic acid include phthalic acid, isophthalic acid, terephthalic acid, maleic acid, fumaric acid, adipic acid and sebasic acid.

Commercially available products of the above polyester diols include Kurapol P-2010, P-1010, L-2010, L-1010, A-2010, A-1010, F-2020 and F-1010, PMIPA-2000, PKA-A, PNOA-2010 and PNOA-101 (of Kuraray Co., Ltd.).

The polycarbonate diols include polycarbonates of polytetrahydrofuran and polycarbonates of 1,6-hexanediol. Commercially available products of the polycarbonate diols include DN-980, 981, 982 and 983 (of Nippon Polyurethane Co., Ltd.), PC-8000 (of PPG Industries, Inc.) and PC-THF-CD (of BASF AG).

The polycaprolactone diols are obtained by reacting ε-caprolactone with a diol. Examples of the diol include ethylene glycol, polyethylene glycol, propylene glycol, polypropylene glycol, tetramethylene glycol, polytetramethylene glycol, 1,2-polybutylene glycol, 1,6-hexanediol, neopentyl glycol, 1,4-cyclohexanedimethanol and 1,4-butanediol. These polycaprolactone diols are available as commercially available products such as Praccel 205, 205AL, 212, 212AL, 220 and 220AL (of Daicel Chemical Industries, Ltd.).

The polyfunctional polyol compounds having three or more hydroxyl groups in one molecule include polyether polyols, polyester polyols, polycarbonate polyols, polyether carbonate polyols, polyester carbonate polyols and trifunctional addition reaction products represented by the following formula:

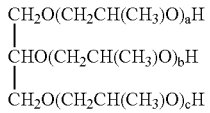

$$\begin{array}{l} CH_2O(CH_2CH(CH_3)O)_aH \\ | \\ CHO(CH_2CH(CH_3)O)_bH \\ | \\ CH_2O(CH_2CH(CH_3)O)_cH \end{array}$$

wherein a, b and c are each independently an integer of 0 to 100, with the proviso that a, b and c are not 0 at the same time, and obtained by adding propylene oxide to glycerin, all of which are manufactured from a triol such as glycerin, trimethylol propane, 1,2,6-hexanetriol or triethanol amine, or tetraol such as pentaerythritol or tetramethylol cyclohexane as a starting polyol component. The trifunctional addition reaction products are available as commercially available products such as Uniol TG330 (of NOF Corporation).

The polyfunctional low molecular weight alcohols having two or more hydroxyl groups in one molecule include ethylene glycol, 1,3-propanediol, 1,4-butanediol, 1,6-hexanediol, 1,4-bis(hydroxyethoxy)benzene and trimethylolpropane.

Out of the above compounds Y having two or more OH groups in one molecule, polyether polyols are preferred because the decomposition of a polymer by hydrolysis is suppressed, and polyether diols are more preferred because they reduce the number of unreacted OH groups to improve water resistance.

The number average molecular weight of the compound Y having two or more OH groups in one molecule is in the range of preferably 300 to 2,000, more preferably 400 to 1,500. Two or more compounds may be used in combination as the compound Y. In this case, the number average molecular weight of the compound Y is an arithmetic mean value obtained in consideration of the use ratio and number average molecular weights of these compounds. When the number average molecular weight is lower than 300, the hardness and elastic modulus of the obtained polymer matrix become too high, whereby when the obtained polishing pad is used, a large number of scratches tend to be produced. When the number average molecular weight is higher than 2,000, the hardness and elastic modulus of the obtained polymer matrix become too low, whereby the obtained polishing pad tends to be inferior in planarizability.

As the polyisocyanate used in the present invention is used a compound having at least two isocyanate groups in the molecule. Examples of the polyisocyanate compound include aromatic di- or tri-isocyanates, aliphatic di- or tri-isocyanates, alicyclic di- or tri-isocyanates and modified products of polyisocyanates. The aromatic di- or tri-isocyanates include 2,4-tolylene diisocyanate, 2,6-tolylene diisocyanate, phenylene diisocyanate, xylylene diisocyanate, tetramethylxylene diisocyanate, 2,2'-diphenylmethane diisocyanate, 2,4'-diphenylmethane diisocyanate, 4,4'-diphenylmethane diisocyanate, tolidine diisocyanate, bis(4-isocyanate-3-methylphenyl)methane, triphenylmethane triisocyanate and 1,5-naphthalene diisocyanate. The aliphatic di- or tri-isocyanates include 1,4-tetramethylene diisocyanate, 1,6-hexamethylene diisocyanate, trimethylhexamethylene diisocyanate, 1,10-decamethylene diisocyanate, lysine diisocyanate and 1,3,6-hexamethylene triisocyanate. The alicyclic di- or -tri-isocyanates include isophorone diisocyanate, hydrogenated xylylene diisocyanate and hydrogenated diphenylmethane diisocyanate. The modified products of polyisocyanates include adducts of a polyhydric alcohol with a polyisocyanate, dimers, trimers having an isocyanurate ring, allophanate modified products, urea modified polyisocyanates and burette modified polyisocyanates. Out of these, the aromatic di- or tri-isocyanates and aliphatic di- or tri-isocyanates are preferred, and aromatic diisocyanates and aliphatic diisocyanates are particularly preferred. The above polyisocyanates may be used alone or in combination of two or more.

The thus obtained isocyanate-terminated urethane prepolymers may be used alone or in combination of two or more.

Chain Extender B

The chain extender in the present invention is a compound having in the molecule two or more functional groups with active hydrogen capable of reacting with the isocyanate groups of the isocyanate-terminated urethane prepolymer A.

Examples of the functional group having active hydrogen include OH group, primary or secondary amino group and carboxyl group.

Examples of the compound having OH groups are the same as those of the compound Y having two or more OH groups in the molecule enumerated for the above isocyanate-terminated urethane prepolymer A.

The compound having primary amino groups or secondary amino groups is, for example, a polyamine compound. Examples of the polyamine compound include organic diamine compounds such as 3,3'-dichloro-4,4'-diaminodiphenylmethane, chloroaniline modified dichlorodiaminodiphenylmethane, 1,2-bis(2-aminophenylthio)ethane, trimethylene glycol-di-p-aminobenzoate and 3,5-bis(methylthio)-2,6-toluenediamine. Compounds having three or more primary amino groups or secondary amino groups in one molecule may also be used.

Examples of the compound having carboxyl groups include aliphatic, aromatic, alicyclic and heterocyclic dicarboxylic acids, tricarboxylic acids and tetracarboxylic acids.

The aliphatic dicarboxylic acids include oxalic acid, malonic acid, succinic acid, glutaric acid, adipic acid and azelaic acid.

The aromatic dicarboxylic acids include phthalic acid, isophthalic acid and terephthalic acid. The aromatic tetracarboxylic acids include pyromellitic acid. The alicyclic dicarboxylic acids include cyclohexyldicarboxylic acid. The heterocyclic dicarboxylic acids include naphthalene dicarboxylic acid. The alicyclic tricarboxylic acids include citric acid and aconitic acid.

These compounds may be used alone or in combination of two or more. Out of these, compounds having OH groups or amino groups are preferred because they have high reactivity with isocyanate groups, and compounds having OH groups are particularly preferred because they have suitable reactivity for handling in the process.

The chain extender B in the present invention is a compound having three or more active hydrogen-containing functional groups in the molecule or a mixture of a compound having two active hydrogen-containing functional groups in the molecule and a compound having three or more active hydrogen-containing functional groups in the molecule. To cause a suitable reduction in the elastic modulus of the polishing layer upon a rise in temperature which is the feature of the present invention, a compound having three or more active hydrogen-containing functional groups in the molecule must be contained in an amount of 20 to 100 wt %, preferably 30 to 100 wt % based on 100 wt % of the total of the chain extenders. When the amount of the compound having three or more active hydrogen-containing functional groups in the molecule is smaller than 20 wt %, a reduction in the elastic modulus of the polishing layer upon a rise in temperature becomes small and scratching readily occurs on the object to be polished. When the amount of the compound having three or more active hydrogen-containing functional groups in the molecule is smaller than 20 wt %, projections formed by the elongation of the polymer which remains after the polymer matrix is broken by dressing with a diamond dresser for roughening the surface of the polishing pad become large, whereby large polymer projections on the surface of the polishing pad increase in number and enter recesses in the object during polishing with the result of reduced planarizability.

The chain extender B in the present invention contains 50 to 100 wt % of a chain extender having a number average molecular weight of 300 or less, preferably 50 to 100 wt % of a chain extender having a number average molecular weight of 250 or less based on 100 wt % of the total of chain extenders in addition to the above condition. A chain extender having a number average molecular weight higher than 300 may be contained in an amount of 0 to 50 wt %. When the amount of the chain extender having a number average molecular weight of 300 or less is smaller than 50 wt %, phase separation between a hard segment and a soft segment in the obtained polymer matrix becomes incomplete and a reduction in elastic modulus upon a rise in temperature becomes excessive with the result that fluctuations in the polishing performance of the polishing pad become large, thereby making polishing unstable. Due to this incomplete phase separation, the water absorption of the polymer matrix occurs, thereby causing a reduction in the hardness of the polishing pad disadvantageously.

The chain extender B and the compound Y having two or more OH groups in the molecule used for the manufacture of the isocyanate-terminated urethane prepolymer A of the present invention are preferably used in a ratio of the number average molecular weight of the compound Y to the number average molecular weight of the chain extender B of preferably 3 or more, more preferably 4 to 10. When this number molecular weight ratio is lower than 3, phase separation between the hard segment and the soft segment in the obtained polymer matrix tends to become incomplete and a reduction in elastic modulus upon a rise in temperature tends to become excessive with the result that fluctuations in the polishing performance of the polishing pad tend to become large, thereby making polishing unstable.

When a plurality of compounds are used in combination as the compound Y and the chain extender B, the number average molecular weight of the compound Y and the number average molecular weight of the chain extender B are arithmetic mean values which are calculated in consideration of the ratio and number average molecular weights of the plurality of compounds.

Mixture and Curing Reaction of Raw Materials (Isocyanate-terminated Urethane Prepolymer A and Chain Extender B)

In the synthetic reaction of a polyurethane or polyurethane-urea which will become the polymer matrix forming the polishing layer of the polishing pad of the present invention, the amounts of the isocyanate-terminated urethane prepolymer A and the chain extender B having active hydrogen-containing functional groups are such that the molar ratio of the active hydrogen-containing group contained in the chain extender B to the isocyanate group contained in the isocyanate-terminated urethane prepolymer A is preferably 1/0.9 to 1/1.4, more preferably 1/0.95 to 1/1.3. When the molar ratio of the active hydrogen-containing group to the isocyanate group falls below 0.9, a large number of unreacted active hydrogen-containing groups remain and the obtained polyurethane becomes inferior in water resistance, alkali resistance and acid resistance. When the molar ratio of the isocyanate group exceeds 1.4, a large number of unreacted isocyanate groups remain at the end of the polymerization reaction and cause a crosslinking reaction by moisture along the passage of time, and the obtained polymer matrix becomes fragile.

Preferably, before the mixing of the raw materials (isocyanate-terminated urethane prepolymer A and chain extender B), vacuum defoaming is carried out while the raw materials are heated at a temperature higher than the temperatures at which they become liquid and then they are mixed together. The polishing performance can be stabilized by preventing foam from being contained in the obtained polishing layer due to the process.

The raw materials can be mixed together by using a inversion agitator having 1 to 3 elements with such agitation force that foam is not contained after the raw materials (isocyanate-terminated urethane prepolymer A and chain extender B) are weighed and placed in an agitation vessel. When continuous productivity is taken into consideration, a casting machine equipped with independent agitation/defoaming tanks for the isocyanate-terminated urethane prepolymer A and the chain extender B and capable of continuously mixing the two different raw materials by means of a line mixer is preferably used.

In the synthesis reaction of the polymer matrix, the above mixture of the raw materials is heated to provide heat energy, or a reaction promoter is optionally used to promote the reaction. Examples of the reaction promoter include tertiary amines such as triethylamine, benzyl dimethylamine, triethylenediamine, tetramethylbutane diamine and 2-methyl-triethylene diamine; tin compounds such as dibutyltin acetate, dibutyltin dilaurate, dibutyltin maleate, dibutyltin di-2-ethyl-hexoate, dilauryltin diacetate and dioctyltin diacetate; and diaza-bicycloalkene and organic acid salts thereof.

To suppress the residual metal contained in the polishing layer when the polishing pad is used for a semiconductor wafer, the reaction promoter is not used, or a tertiary amine, diaza-bicycloalkene or a salt thereof is preferably used when the reaction promoter is used.

The temperature, time and pressure of the synthesis reaction of the polymer matrix are not particularly limited. The first stage of the synthesis reaction is preferably carried out under conditions under which the polymer matrix can be removed from a metal mold after it is reacted to some extent so as to suppress its tackiness and transformability. For example, the reaction is preferably carried out at 30 to 170° C. for 3 minutes to 24 hours. The reaction is more preferably carried out at 50 to 130° C. for 5 minutes to 3 hours. Although the reaction can be completed in this first stage, the polymer matrix is maintained at 80 to 150° C. for 3 to 24 hours to carry out the second stage of the reaction so as to further complete the reaction.

The Shore D hardness of the polishing layer of the polishing pad obtained by the above reaction is preferably 30 or more, more preferably 40 to 90, most preferably 50 to 80. When the Shore D hardness is 30 or more, pressure applied to the object to be polished can be made large and the removal rate can be thereby improved.

Water-soluble Particles C

Another preferred embodiment of the present invention is a polishing pad having a polishing layer comprising water-soluble particles dispersed in the above polymer matrix. In this polishing pad, the water-soluble particles are eliminated from the polymer matrix upon their contact with water during dressing or slurry which is an aqueous dispersion during polishing in the surface layer of the pad while the polishing pad is used. This elimination occurs when the water-soluble particles come into contact with water or water contained in the slurry to be dissolved in the water or when the water-soluble particles swell with water to be gelled. Further, this dissolution or swelling occurs not only upon their contact with water but also upon their contact with an aqueous mixed medium containing an alcohol-based solvent such as methanol.

The water-soluble particles have the effect of increasing the indentation hardness of the polishing pad and reducing the indentation of the polishing pad into the object to be polished by pressure in the polishing pad in addition to the effect of forming pores. For example, the Shore D hardness of the polishing layer of the polishing pad of the present invention can be set to preferably 35 or more, more preferably 40 to 95, most preferably 50 to 90 by containing the water-soluble particles. When the Shore D hardness is 35 or more, pressure applied to the object to be polished can be made large and the removal rate can be thereby improved.

In addition, high polishing planarity for the object to be polished can be obtained by the existence of the water-soluble particles. Therefore, the water-soluble particles are preferably solid so that they can ensure sufficiently high indentation hardness for the polishing pad.

The material constituting the water-soluble particles is not particularly limited. They are, for example, organic water-soluble particles or inorganic water-soluble particles. Examples of the material of the organic water-soluble particles include saccharides (polysaccharides such as starch, dextrin and cyclodextrin, lactose, mannitol, etc.), celluloses (such as hydroxypropyl cellulose, methyl cellulose, etc.), protein, polyvinyl alcohol, polyvinyl pyrrolidone, polyacrylic acid and salts thereof, polyethylene oxide, water-soluble photosensitive resins, sulfonated polyisoprene and sulfonated polyisoprene copolymers. Examples of the material of the inorganic water-soluble particles include potassium acetate, potassium nitrate, potassium carbonate, potassium hydrogencarbonate, potassium chloride, potassium bromide, potassium phosphate and magnesium nitrate. These water-soluble particles may be used alone or in combination of two or more.

The water-soluble particles have an average particle diameter of preferably 0.1 to 500 μm, more preferably 0.5 to 300 μm, much more preferably 1 to 100 μm, particularly preferably 10 to 90 μm. The pores formed by the elimination of the water-soluble particles are as big as preferably 0.1 to 500 μm, more preferably 0.5 to 300 μm, much more preferably 1 to 100 μm, particularly preferably 10 to 90 μm. When the average particle diameter of the water-soluble particles is smaller than 0.1 μm, the formed pores become smaller in size than the abrasive grains in use, whereby it may be difficult to obtain a polishing pad capable of holding slurry completely. When the average particle diameter is larger than 500 μm, the formed pores become too big, whereby the mechanical strength and removal rate of the obtained polishing pad may lower.

The amount of the water-soluble particles is preferably 0.5 to 70 vol %, more preferably 1 to 60 vol %, particularly preferably 2 to 45 vol % based on 100 vol % of the polishing layer consisting of the polymer matrix and the water-soluble particles. When the amount of the water-soluble particles is smaller than 0.5 vol %, pores are not fully formed in the obtained polishing pad and the removal rate may lower. When the amount of the water-soluble particles is larger than 70 vol %, it may be difficult to completely prevent the water-soluble particles existent in the interior of the obtained polishing pad from swelling or dissolving during polishing, thereby making it difficult to maintain the hardness and mechanical strength of the polishing pad at appropriate values.

The calculation of the amount of the water-soluble particles in terms of weight can be carried out as follows. For example, when a saccharide having a specific gravity of about 1.5 is used as the water-soluble particles and a polyurethane having a specific gravity of 1.15 after the end of the reaction is used as the polymer matrix, the amount of the water-soluble particles is preferably 0.7 to 75.3 wt %, more preferably 1.3 to 66.2 wt %, particularly preferably 2.6 to 51.6 wt % based on 100 wt % of the polishing layer. When polyacrylic acid, polyvinyl pyrrolidone or polyethylene oxide having a specific gravity of about 1.15 is used as the water-soluble particles and a polyurethane having a specific gravity of 1.15 after the end of the reaction is used as the polymer matrix, the amount of the water-soluble particles is preferably 0.5 to 70 wt %, more preferably 1 to 60 wt %, particularly preferably 2 to 45 wt % based on 100 wt % of the polishing layer. Further, when inorganic water-soluble particles such as potassium nitrate having a specific gravity of about 2 are used as the water-soluble particles and a polyurethane having a specific gravity of 1.15 after the end of the reaction is used as the polymer matrix, the amount of the water-soluble particles is preferably 0.9 to 80.2 wt %, more preferably 1.7 to 72.3 wt %, particularly preferably 3.4 to 58.7 wt % based on 100 wt % of the polishing layer.

It is preferred that the water-soluble particles should dissolve in water only when they are exposed to the surface layer of the polishing pad and should not absorb moisture or swell when they are existent in the interior of the polishing pad. Therefore, the water-soluble particles preferably have an outer shell for suppressing moisture absorption on at least part of the surface. This outer shell may be physically adsorbed to the water-soluble particle, chemically bonded to the water-soluble particle, or in contact with the water-soluble particle by physical adsorption and chemical bonding. The outer shell is made of epoxy resin, polyimide resin, polyamide resin, silicon resin or coupling agent which will be described hereinafter as a dispersant. Even when it is formed on only part of the surface of the water-soluble particle, the above effect can be fully obtained.

When the water-soluble particles are used, prior to the mixing of all the raw materials, the water-soluble particles are preferably dispersed in the above isocyanate-terminated urethane prepolymer A and/or the chain extender B as a raw material solution in advance. In order to prevent the water-soluble particles from swelling with the raw material solution and from dissolving in the raw material solution at the time of dispersion, particularly preferably, the water-soluble particles are dispersed into the isocyanate-terminated urethane prepolymer A having a higher molecular weight than the chain extender B. Although the dispersion method is not particularly limited, preferably, the water-soluble particles are added and dispersed little by little while the isocyanate-terminated urethane prepolymer A or the chain extender B (or both of them in separate vessels) is stirred in a vessel so as to obtain a good dispersion. Particularly preferably, the water-soluble particles are dispersed by using a double-screw mixer capable of obtaining shear force. To prevent foam from being contained in the obtained polishing layer, defoaming is preferably carried out under reduced pressure during or after the dispersion of the water-soluble particles.

A dispersion aid may be optionally used. Examples of the dispersion aid include homopolymers, block copolymers and random copolymers modified by an acid anhydride group, carboxyl group, hydroxyl group, epoxy group, oxazoline group or amino group, nonionic surfactants and coupling agents.

Mixing and Reaction of Raw Martial(s) Containing Water-soluble Particles Dispersed Therein The polishing layer made of a polyurethane or polyurethane-urea containing water-soluble particles dispersed therein of the present invention is obtained by carrying out the mixing of a raw material(s) containing the water-soluble particles dispersed therein and the synthesis reaction of the polymer matrix in the same manner as in the item of the mixing and curing reaction of raw materials (isocyanate-terminated urethane prepolymer A and chain extender B) except that the raw material(s) (prepolymer A, chain extender B or both of them) containing the water-soluble particles dispersed therein prepared by the above method is/are used.

Other Usable Additives

Components other than the above components may be added to the polymer matrix and/or the water-soluble particles in limits that do not impair the effect of the present invention.

To include these additives in the polishing layer of the polishing pad of the present invention, they must be added to the raw material before the formation of the polymer matrix.

Polishing Pad

The polishing layer of the polishing pad of the present invention is obtained by reacting a raw material mixture (isocyanate-terminated urethane prepolymer A and chain extender B) or a raw material mixture solution containing water-soluble particles dispersed therein, prepared by the above method, in a metal mold, for example. The polishing layer of the polishing pad of the present invention is characterized in that when its temperature is raised by frictional heat generated by extreme polishing conditions or frictional heat generated by excessive pressure from coarse foreign matter, its elastic modulus drops to an appropriate value. Scratching can be prevented by easing excessive stress to the object to be polished by this reduction in elastic modulus (softening). By suppressing an excessive reduction in elastic modulus upon a change in temperature, planarization performance at the time of polishing can be improved. To achieve this suitable change in elastic modulus by temperature, the ratio of the storage elastic modulus E' at 30° C. to E' at 60° C. of the polishing layer is in the range of 2 to 15, preferably 3 to 10 and the ratio of E' at 30° C. to E' at 90° C. is in the range of 4 to 20, preferably 5 to 15.

The storage elastic modulus E' should be understood as a value at 30° C. or 60° C. when a strip having a width of 3 mm, a thickness of 3 mm and a length of 32 mm is cut out from a sheet and measured in a tensile mode at a measurement temperature of −20 to 130° C., an initial load of 50 g, a dynamic bias of 0.05% and a frequency of 10 rad/s and at a temperature elevation rate of 5° C./min by using a commercially available dynamic viscoelasticity measuring instrument.

This polishing layer may constitute at least part of the polishing surface of the polishing pad. It constitutes preferably at least 50% or more, more preferably 80% or more, particularly preferably 90% or more of the polishing surface. The entire polishing surface may be composed of the polishing layer.

A portion other than the polishing layer is, for example, a window portion for detecting the end point by using an optical end-point detector. The window portion is made of a material having an optical transmittance at a wavelength of 100 to 3,000 nm of 0.1% or more, preferably 2% or more, or an integral transmittance at a wavelength of 100 to 3,000 nm of 0.1% or more, preferably 2% or more, with a thickness of 2 mm.

Further, the polishing layer of the polishing pad may be a single layer or a laminate comprising another layer. In the case of the laminate, the polishing layer is a layer forming the polishing surface in the laminate. Layers other than the polishing layer are, for example, a support layer arranged on the surface opposite to the polishing surface of the polishing layer and a bonding layer for joining the support layer and the polishing layer together.

The above support layer is a layer for supporting the polishing layer on the rear side. Although the characteristic properties of this support layer are not particularly limited, the support layer is preferably softer than the polishing layer. When the pad has a soft support layer, if the polishing layer is thin, for example, 0.5 mm or less, it is possible to prevent the polishing layer from rising during polishing or the surface of the polishing layer from curving, thereby making possible stable polishing. The hardness of the support layer is preferably 90% or less, more preferably 80% or less, particularly preferably 70% or less and generally 10% or more of the hardness of the polishing layer. The Shore D hardness of the support layer is preferably 70 or less, more preferably 60 or less, particularly preferably 50 or less and generally 1 or more.

The support layer may be foamed or not foamed. The plane shape of the support layer is not particularly limited and may be the same or different from that of the polishing layer. The plane shape of the support layer may be circular or polygonal, for example, tetragonal. Its thickness is not particularly limited but preferably 0.1 to 5 mm, more preferably 0.5 to 2 mm. When the polishing layer has a window portion for detecting the end point by using the optical end-point detector, the window portion has a similar shape or the same shape as the polishing layer not to block off light passing through the window portion, or a cut-out for transmitting light may be formed without the window portion.

The material constituting the support layer is not particularly limited. An organic material is preferably used because it is easily molded to have a predetermined shape and properties and can provide suitable elasticity. Various polymers may be used as the organic material. The organic material constituting the support layer may be a crosslinked polymer, a polymer which is not yet crosslinked, or a non-crosslinked polymer.

The support layer may consist of a single layer or multiple layers. Further, the support layer and the polishing layer may be assembled together by thermal fusion directly or by the above bonding layer. The bonding layer is a cured layer of an adhesive or a layer made of a pressure sensitive adhesive, such as an adhesive tape.

The shape of the polishing pad of the present invention is not particularly limited and may be disk-like, belt-like or roller-like. Preferably, it can be suitably selected according to a polishing machine. The size of the polishing pad before use is not particularly limited. In the case of a disk-like polishing pad, its diameter is preferably 0.5 to 500 cm, more preferably 1.0 to 250 cm, particularly preferably 20 to 200 cm and its thickness is preferably larger than 0.1 mm and 100 mm or less, particularly preferably 1 to 10 mm.

Which polishing process this polishing pad is used in is not particularly limited. For example, the polishing pad can be suitably used in the STI process (shallow-trench isolation process) in the polishing of a semiconductor wafer, the damascene process for forming metal wiring made of Al or Cu, the damascene process for forming a via plug made of Al, Cu or W, the dual damascene process for forming metal wiring and a via plug at the same time, the process of polishing an interlayer insulating film (such as oxide film, Low-k or BPSG), the process of polishing a nitride film (such as TaN or TiN), and the process of polishing polysilicon or monocrystal silicon.

An open groove(s) and/or recess(es) may be formed on the polishing surface of the polishing pad. The groove(s) and/or recess(es) serve(s) to hold slurry supplied at the time of polishing and distribute it to the polishing surface more uniformly. It/they also serve(s) to retain wastes such as powders generated by polishing and used slurry temporarily and to become a discharge route for discharging the wastes to the outside. The shape of the groove(s) is not particularly limited. It may be annular, lattice-like, radial and/or spiral.

The plane shape of the annular groove is not particularly limited and may be circular, polygonal such as triangular, tetragonal or hexagonal, or elliptic. The number of grooves formed on the polishing pad is preferably two or more. Although the arrangement of the grooves is not particularly limited, the grooves may be arranged concentrically or eccentrically, or a plurality of annular grooves may be surrounded by a single annular groove on the inner portion of the polishing surface. Out of these, preferably, grooves are arranged concentrically. More preferably, a plurality of circular grooves are arranged concentrically. A polishing pad having circular grooves arranged concentrically is superior to other polishing pads in the above functions. When the circular grooves are arranged concentrically, they are excellent in these functions and also easily formed.

A single continuous groove or two or more discontinuous grooves may form a lattice. The plane shape of one pattern constituting the lattice is not particularly limited and may be polygonal. This polygonal pattern may be tetragonal such as square, rectangular, trapezoidal or diamond-shaped, trigonal, pentagonal or hexagonal.

The radial grooves consist of a plurality of grooves extending from the center portion of the polishing surface toward the periphery. The grooves may extend from the center portion toward the periphery and the shape of the grooves may be linear, arcuate or a combination thereof. Although the grooves may or may not reach the peripheral end, at least one of them preferably reaches the periphery end, that is, the side surface of the pad. For example, the plurality of grooves may consist of a plurality of linear grooves extending from the center portion toward the periphery at least one of which can reach the side surface of the pad, or the plurality of grooves may consist of a plurality of linear grooves extending from the center potion toward the periphery and a plurality of linear grooves which extend from a halfway position between the center portion and the peripheral portion toward the periphery at least one of which can reach the side surface of the pad. The plurality of grooves may consist of pairs of parallel linear grooves.

One spiral continuous groove may be formed, or two spiral grooves which differ from each other in direction may be formed. Further, two spiral grooves which are the same in direction may be formed, or three or more spiral grooves which are the same or differ in direction may be formed.

The size of the above groove is not particularly limited. For example, the width of the groove is preferably 0.1 mm or more, more preferably 0.1 to 5 mm, much more preferably 0.2 to 3 mm, particularly preferably 0.5 to 1 mm. In general, it is difficult to form a groove having a width or a minimum size smaller than 0.1 mm. The depth of the groove is preferably 0.1 mm or more, more preferably 0.3 to 2.5 mm, much more preferably 1 to 2.2 mm, particularly preferably 1.3 to 2 mm. When the depth of the groove is smaller than 0.1 mm, the service life of the polishing pad tends to become too short disadvantageously. Further, the interval between grooves (the minimum distance between adjacent portions in the radial direction of spiral grooves) is preferably 0.05 mm or more, more preferably 0.05 to 100 mm, much more preferably 0.1 to 10 mm, particularly preferably 0.5 to 2 mm. It is difficult to form grooves having a minimum distance smaller than 0.05 mm. The pitch which is the sum of the width of the groove and the distance between adjacent grooves is preferably 0.15 mm or more, more preferably 0.15 to 105 mm, much more preferably 0.3 to 13 mm, particularly preferably 0.5 to 2.2 mm.

The above preferred ranges may be combined. For example, the grooves preferably have a width of 0.1 mm or more, a depth of 0.1 mm or more and a minimum distance of 0.05 mm or more, more preferably a width of 0.1 to 5 mm, a depth of 0.3 to 2.5 mm and a minimum distance of 0.05 to 100 mm, much more preferably a width of 0.2 to 3 mm, a depth of 1 to 2.2 mm and a minimum distance of 0.1 to 10 mm, particularly preferably a width of 0.5 to 1 mm, a depth of 1.3 to 2 mm and a minimum distance of 0.5 to 2 mm.

Further, the surface roughness of the inner wall of the groove is preferably 20 μm or less, more preferably 15 μm or less, most preferably 10 μm or less and generally 0.05 μm or more. When this surface roughness is 20 μm or less, scratching at the time of polishing can be effectively prevented. This surface roughness should be understood as a value before the use of the polishing pad of the present invention.

When the surface roughness of the inner wall of the groove is 20 μm or less, large variations are not existent. When large variations are existent, particularly large projections, for example, chippings generated at the time of forming grooves are eliminated during polishing with the result of scratching. Further, scratching may occur by foreign matter formed by a compression due to pressures or friction heats during polishing, or by interaction between the eliminated projections and powders generated by polishing or a solid contained in the slurry. The projections may be eliminated during dressing to cause the same inconvenience.

Further, when the surface roughness is 20 μm or less, scratching can be prevented and also the functions of the grooves, particularly the function of distributing slurry to the polishing surface and the function of discharging wastes to the outside can be efficiently obtained.

The plane shape of the above recess(es) is not particularly limited. For example, it may be circular, polygonal such as trigonal, tetragonal or pentagonal, or elliptic. The sectional form of the recess(es) is not particularly limited as well. For example, it may be a shape formed by flat side surfaces and a bottom surface (the sizes in the transverse direction of the open side and the bottom side may be the same, the size of the open side may be larger than the size of the bottom side, or the size of the bottom side may be larger than the size of the open side), U-shaped or V-shaped.

Further, the surface roughness of the inner wall of the recess is 20 μm or less, preferably 15 μm or less, more preferably 10 μm or less and generally 0.05 μm or more as well as that of the inner wall of the groove.

The patterns of the grooves may be formed on the surface of the polishing pad by cutting with a cutting machine having a blade. The material constituting the blade is not particularly limited but may be selected from carbon steel, alloy steel, high speed steel, super hard alloy, cermet, stellite, super high pressure sintered body and the other ceramics. A single blade or multi-blade unit having a plurality of blades may be used.

A polishing layer having grooves on the surface can be formed without cutting by forming a mold having the above groove pattern in a vessel (for example, a metal mold) used for a reaction, injecting the raw material mixture into the vessel and curing it.

In the polishing pad of the present invention, a suitable change in elastic modulus by temperature can be provided to the polymer matrix, thereby making it possible to obtain the effect of suppressing scratching and high planarizabiilty at the same time. A high removal rate can be provided by the polishing pad containing water-soluble particles dispersed uniformly therein according to another embodiment of the present invention in addition to the above characteristic properties.

EXAMPLES

The following examples and comparative examples are provided to further illustrate the present invention.

The constitutions and evaluation results of the polishing pads used in examples and comparative examples are shown in Table 1. The unit of the figures showing the ratios of components in Table 1 is parts by mass.

Example 1

100 parts by weight of β-cyclodextrin (manufactured by Bio Research Corporation of Yokohama, trade name of Dexy Pearl β-100, average particle diameter of 20 μm) as water-soluble particles was injected into a mixer (manufactured by Kawata MFG Co., Ltd., trade name of Super Mixer SMZ-3SP), and 0.5 part by weight of γ-aminopropyltriethoxysilane (manufactured by Nippon Unicar Co., Ltd., trade name of A-1100) was sprayed by an atomizer for 5 minutes to be mixed with the above water-soluble particles under agitation at 400 rpm. Then, agitation was further continued at 400 rpm for 2 minutes. Thereafter, the particles taken out from the mixer were dried by heating in a vacuum drier set at 130° C. until the water content of the particles became 5,000 ppm or less to obtain β-cyclodextrin whose surface had been treated with the silane coupling agent.

58 parts by weight of 4,4'-diphenylmethane diisocyanate (manufactured by Sumika Bayer Urethane Co., Ltd., trade name of Sumijule 44S) was fed to a reactor, 5.1 parts by weight of polytetramethylene glycol having two hydroxyl groups at both terminals of the molecule and a number average molecular weight of 650 (manufactured by Mitsubishi Chemical Corporation, trade name of PTMG650) and 17.3 parts by weight of polytetramethylene glycol having a number average molecular weight of 250 (manufactured by Mitsubishi Chemical Corporation, trade name of PTMG250) were added to the reactor under agitation at 60° C. to carry out a reaction at 90° C. for 2 hours under agitation, and then the reaction product was cooled to obtain an isocyanate-terminated prepolymer. This isocyanate-terminated prepolymer was a mixture of 21 wt % of unreacted 4,4'-diphenylmethane diisocyanate and 79 wt % of a prepolymer having isocyanate groups at both terminals.

80.4 parts by weight of the obtained isocyanate-terminated prepolymer was fed to a stirring vessel and maintained at 90° C., 14.5 parts by weight of the above obtained water-soluble particles whose surface had been treated with the silane coupling agent were added to the prepolymer under agitation at 200 rpm, and mixed and dispersed for 1 hour, and then vacuum defoaming was carried out to obtain an isocyanate-terminated prepolymer containing the water-soluble particles dispersed therein.

12.6 parts by weight of 1,4-bis(β-hydroxyethoxy)benzene having two hydroxyl groups at terminals (manufactured by Mitsui Fine Chemicals Inc., trade name of BHEB) was heated at 120° C. in a stirring vessel for 2 hours to be molten, and 7 parts by weight of trimethylolpropane having three hydroxyl groups (manufactured by BASF Japan Ltd., trade name of TMP) was added to the molten product under agitation to be mixed and dissolved for 10 minutes so as to obtain a mixture of chain extenders.

19.6 parts by weight of the mixture of chain extenders obtained above and heated at 120° C. was added to and mixed with 94.9 parts by weight of the isocyanate-terminated prepolymer containing the dispersed water-soluble particles obtained above for 1 minute while the prepolymer was heated at 90° C. and stirred in an agitation mixer so as to obtain a raw material mixture.

The above raw material mixture was injected into a metal mold having a disk-like cavity with a diameter of 600 mm and a thickness of 3 mm until it filled the cavity and maintained at 110° C. for 30 minutes to carry out a polyurethanation reaction, and the obtained molded product was removed from the mold. Further, the obtained molded product was post-cured in a gear oven at 110° C. for 16 hours to obtain a polyurethane sheet containing the dispersed water-soluble particles and having a diameter of 600 mm and a thickness of 3 mm. The volume fraction of the water-soluble particles to the entire sheet, that is, the volume fraction of the water-soluble particles to the total volume of the polyurethane matrix and the water-soluble particles was 10%.

The Shore D hardness of the obtained sheet was 84. The sheet was cut into a strip having a width of 3 mm, a thickness of 3 mm and a length of 32 mm to be measured in a tensile mode at a measurement temperature of −20 to 130° C., an initial load of 50 g, a dynamic bias of 0.05% and a frequency of 10 rad/s and at a temperature elevation rate of 5° C./min by using the Solids Analyzer RSA-II dynamic viscoelasticity measuring instrument (of Rheometrics, Inc.). The storage elastic moduli at 30° C., 60° C. and 90° C. of the strip were 1,895 MPa, 175 MPa and 110 MPa, respectively, the ratio of the storage elastic modulus at 30° C. to the storage elastic modulus at 60° C. was 10.8, and the ratio of the storage elastic modulus at 30° C. to the storage elastic modulus at 90° C. was 17.2. When the hardness of the sheet was measured after it was immersed in deionized water at 23° C. for 24 hours as an index of water-resistance stability when it was used for polishing while in contact with slurry, the Shore D hardness of the sheet was 77 which was 7 points lower than that before immersion.

Concentric grooves having a pitch of 2 mm, a width of 0.5 mm and a depth of 1.5 mm were formed on the entire surface of the sheet excluding a 30 mm center portion of the sheet and the peripheral portion of the sheet was removed except for a 50.8 cm-diameter center portion by using a cutting machine, and a pressure sensitive double coated tape (442JS of 3M Ltd.) was affixed to the entire rear surface devoid of the grooves of the sheet to obtain a polishing pad. The polishing performance of the polishing pad was evaluated as follows.

(1) Removal Rate and Existence of Scratch

A $SiO_2$ solid film semiconductor wafer (manufactured by Advantec Ltd., thermal oxide wafer having a diameter of 200 mm and a thickness of 1,000 nm) was polished under the following conditions for 2 minutes to evaluate the removal rate, the with-in wafer non-uniformity (WIWNU) of removal rate and the existence of scratching. The removal rate was calculated from the mean value of film thickness differences obtained by measuring the film thickness before and after polishing with an optical film thickness meter at 49 points in the direction of the diameter of the center portion of the wafer excluding the 5 mm peripheral portion of the wafer. The with-in wafer non-uniformity (WIWNU) of removal rate was calculated from above 49 measurement values based on the expression (standard deviation σ/average removal rate×100). The number of scratches was measured with the K2351 wafer defect inspection machine (of KLA Tencor Co., Ltd.). Before polishing, the surface of the pad was roughened (dressed) by using a diamond dresser (A-160 of 3M, Ltd.) for 20 minutes under the same conditions as polishing except that running water having a flow rate of 1,500 ml/min was used. Dressing was carried out simultaneously with the polishing of the wafer while slurry was flown during the evaluation of polishing.

Slurry; 3 times dilution of CMS1101 (manufactured by JSR Corporation, containing silica as abrasive grains) Chemical mechanical polishing machine; MIRRA (of Applied Materials, Inc.)

Slurry flow rate; 200 (ml/min)

Polishing load; retainer ring/membrane=400/250 (g/cm$^2$)

Dressing load; 350 (g/cm$^2$)

Revolution of platen; 63 (rpm)

Revolution of head; 57 (rpm)

Revolution of dresser; 63 (rpm)

Dresser sweep pattern; 12 sweeps/min

As a result, the removal rate was 216 nm/min, the with-in wafer non-uniformity (WIWNU) of removal rate was 6.4%, and the number of scratches was 2,136.

(2) Evaluation of Planarity

The amount of polishing of a $SiO_2$ film in a recess of an $SiO_2$ film pattern was taken as planarity when the about 800 nm initial level difference of the projection of the pattern of a semiconductor wafer having the $SiO_2$ film pattern on the surface with a pattern initial level difference of about 800 nm (manufactured by SKW Associates Co., Ltd., trade name of SKW-7) was polished under the above polishing conditions. As this numerical value is smaller, the planarity of the pattern wafer becomes higher. The film thickness of the $SiO_2$ film was calculated by measuring the film thickness before and after polishing by an optical film thickness meter. As a result, the planarity was 123 nm.

Examples 2 to 10 and Comparative Examples 1 to 3

Polishing pads were obtained in the same manner as in Example 1 except that the raw materials in use and molding conditions were changed as shown in Table 1. The physical properties of the sheets and the polishing performances of the pads were evaluated in the same manner as in Example 1 and are shown in Table 1.

Comparative Examples 4 and 5

Polishing pads were obtained in the same manner as in Example 1 except that commercially available urethane prepolymers (Adiprene LFH120 in Comparative Example 4 and Adiprene L315 in Comparative Example 5 (both manufactured by UNIROYAL CHEMICAL Co., Inc.)) were used as the isocyanate-terminated prepolymer and other raw materials and molding conditions were changed as shown in Table 1. The physical properties of the sheets and the polishing performances of the pads were evaluated in the same manner as in Example 1 and are shown in Table 1.

Comparative Example 6

The physical properties of a sheet was evaluated by using a commercially available single-layer urethane pad having no grooves (IC1000 of Rohm & Haas Electronic Materials Co., Ltd.) and the polishing performance was evaluated by using a commercially available multi-layer urethane pad having concentric grooves (IC1000 (K-groove)/Suba400 of Rohm & Haas Electronic Materials Co., Ltd.). The evaluation results are shown in Table 1.

TABLE 1

| | Ex. 1 | Ex. 2 | Ex. 3 | Ex. 4 | Ex. 5 | Ex. 6 | Ex. 7 | Ex. 8 |
|---|---|---|---|---|---|---|---|---|
| <isocyanate-terminated prepolymer A> | — | — | — | — | — | — | — | — |
| PTMG3000 (number average molecular weight of 3000) | — | — | — | 13.7 | 42.5 | — | — | — |
| PTMG1000 (number average molecular weight of 1000) | — | — | — | 41.1 | 22.9 | — | — | — |
| PTMG850 (number average molecular weight of 850) | — | — | 45.9 | — | — | 45.9 | 45.9 | 45.9 |
| PTMG650 (number average molecular weight of 650) | 5.1 | 16.2 | — | — | — | — | — | — |
| PTMG250 (number average molecular weight of 250) | 17.3 | 12.5 | — | — | — | — | — | — |
| number average molecular weight of compound Y | (341) | (476) | (850) | (1500) | (2300) | (850) | (850) | (850) |
| MDI (diphenylmethane diisocyanate) | 58 | 56.3 | 40.6 | 34.3 | 27.9 | 40.6 | 40.6 | 40.6 |
| Commercially available prepolymer Adiprene LFH120 | — | — | — | — | — | — | — | — |
| Commercially available prepolymer Adiprene L315 | — | — | — | — | — | — | — | — |
| <chain extender B> | | | | | | | | |
| (trifunctional chain extender) trifunctional PPG Uniol TG330 (number average molecular weight of 330) | | | | | | | | |
| trimethylolpropane TMP (molecular weight of 134) | 7 | 10.1 | 4.8 | 4.3 | 4.2 | 4.8 | 4.8 | 4.8 |
| (bifunctional chain extender) PTMG650 (number average molecular weight of 650) | | | | | | | | |
| 1,4-bis(hydroxyethoxy)benzene (molecular weight of 198) | 12.6 | 4.9 | 8.7 | 6.6 | | 8.7 | 8.7 | 8.7 |
| 1,6-hexanediol (molecular weight of 118) | | | | | 2.5 | | | |
| 3,3'-dichloro-4,4'-diaminodiphenylmethane (molecular weight of 267) | | | | | | | | |
| <curing catalyst> | | | | | | | | |
| 2-methyltriethylenediamine [Me-DABCO] Adecastab BT11 | | | | | | | | |

| | Ex. 9 | Ex. 10 | C. Ex. 1 | C. Ex. 2 | C. Ex. 3 | C. Ex. 4 | C. Ex. 5 | C. Ex. 6 |
|---|---|---|---|---|---|---|---|---|
| <isocyanate-terminated prepolymer A> | — | — | — | — | — | — | — | |
| PTMG3000 (number average molecular weight of 3000) | — | — | — | — | — | — | — | IC1000 |
| PTMG1000 (number average molecular weight of 1000) | — | — | — | — | — | — | — | |
| PTMG850 (number average molecular weight of 850) | 45.9 | — | — | — | — | — | — | |
| PTMG650 (number average molecular weight of 650) | — | 15.1 | 15.1 | 15.1 | — | — | — | |
| PTMG250 (number average molecular weight of 250) | — | 11.6 | 11.6 | 11.6 | 23.1 | — | — | |
| number average molecular weight of compound Y | (850) | (476) | (476) | (476) | (250) | unknown | unknown | |
| MDI (diphenylmethane diisocyanate) | 40.6 | 52.3 | 52.3 | 52.3 | 46.3 | — | — | |
| Commercially available prepolymer Adiprene LFH120 | — | — | — | — | — | 86.7 | — | |
| Commercially available prepolymer Adiprene L315 | — | — | — | — | — | — | 79.3 | |
| <chain extender B> | | | | | | | | |
| (trifunctional chain extender) trifunctional PPG Uniol TG330 (number average molecular weight of 330) | | 5.5 | 3 | 5.5 | 13.2 | | | |
| trimethylolpropane TMP | 4.8 | | | | | 2.2 | | |

TABLE 1-continued

| | | | | | | |
|---|---|---|---|---|---|---|
| (molecular weight of 134) (bifunctional chain extender) | | | | | | |
| PTMG650 (number average molecular weight of 650) | | 4.5 | 7 | 5.5 | 17.4 | |
| 1,4-bis(hydroxyethoxy)benzene (molecular weight of 198) | 8.7 | | | | | |
| 1,6-hexanediol (molecular weight of 118) | | 11 | 11 | 10 | | 11.1 |
| 3,3'-dichloro-4,4'-diaminodiphenyl methane (molecular weight of 267) | | | | | | |
| <curing catalyst> | | | | | | |
| 2-methyltriethylenediamine[Me-DABCO] | | | | | 0.1 | |
| Adecastab BT11 | | | | | | 0.015 |

| | Ex. 1 | Ex. 2 | Ex. 3 | Ex. 4 |
|---|---|---|---|---|
| amount (wt %) of chain extender having a number average molecular weight of 300 or less | (100%) | (100%) | (100%) | (100%) |
| amount (wt %) of trifunctional chain extender | (35.7%) | (67.3%) | (35.6%) | (39.4%) |
| number average molecular weight of chain extender B | (175.3) | (155.1) | (175.4) | (172.9) |
| ratio of number average molecular weight of Y to number average molecular weight of B | (1.95) | (3.07) | (4.84) | (8.67) |
| <water-soluble particles C> | | | | |
| β-cyclodextrin (average particle diameter of 20 μm) | 14.4 | 14.4 | 14.4 | 32.4 |
| γ-aminopropyltriethoxysilane A1100 | 0.072 | 0.072 | 0.072 | 0.162 |
| β-cyclodextrin treated with silane coupling agent | 14.5 | 14.5 | 14.5 | 32.6 |
| amount (vol %) of water-soluble particles | (10.0%) | (10.0%) | (10.0%) | (20.0%) |
| <molding conditions> | | | | |
| conditions before removing from mold | 110° C. * 30 min. | 110° C. * 30 min. | 110° C. * 30 min. | 110° C. * 30 min. |
| post-curing conditions | 110° C. * 16 hr. | 110° C. * 16 hr. | 110° C. * 16 hr. | 110° C. * 16 hr. |

| | Ex. 5 | Ex. 6 | Ex. 7 | Ex. 8 |
|---|---|---|---|---|
| amount (wt %) of chain extender having a number average molecular weight of 300 or less | (100%) | (100%) | (100%) | (100%) |
| amount (wt %) of trifunctional chain extender | (62.7%) | (35.6%) | (35.6%) | (35.6%) |
| number average molecular weight of chain extender B | (128.2) | (175.4) | (175.4) | (175.4) |
| ratio of number average molecular weight of Y to number average molecular weight of B | (17.94) | (4.84) | (4.84) | (4.84) |
| <water-soluble particles C> | | | | |
| β-cyclodextrin (average particle diameter of 20 μm) | 55.6 | 1.3 | 240.8 | — |
| γ-aminopropyltriethoxysilane A1100 | 0.278 | 0.006 | 1.204 | — |
| β-cyclodextrin treated with silane coupling agent | 55.9 | 1.3 | 242 | — |
| amount (vol %) of water-soluble particles | (30.0%) | (1.0%) | (65.0%) | — |
| <molding conditions> | | | | |
| conditions before removing from mold | 110° C. * 30 min. | 110° C. * 30 min. | 110° C. * 30 min. | 110° C. * 30 min. |
| post-curing conditions | 110° C. * 16 hr. | 110° C. * 16 hr. | 110° C. * 16 hr. | 110° C. * 16 hr. |

| | Ex. 1 | Ex. 2 | Ex. 3 | Ex. 4 |
|---|---|---|---|---|
| hardness (Shore D) | 84 | 78 | 66 | 55 |
| hardness (Shore D) after 24 hours of immersion in deionized water at 23° C. | 77 | 75 | 65 | 54 |
| <storage elastic modulus E'> | | | | |
| 30° C. E' | 1895 | 1061 | 311 | 93 |
| 60° C. E' | 175 | 163 | 84 | 31 |
| 90° C. E' | 110 | 90 | 62 | 15 |
| ratio of E' at 30° C. to E' at 60° C. | 10.8 | 6.5 | 3.7 | 3.0 |
| ratio of E' at 30° C. to E' at 90° C. | 17.2 | 11.8 | 5.0 | 6.2 |
| <evaluation of polishing performance> | | | | |
| removal rate (nm/min) | 216 | 220 | 223 | 226 |

TABLE 1-continued

| | | | | |
|---|---|---|---|---|
| the with-in wafer non-uniformity (WIWNU) of removal rate (%) | 6.4 | 3.1 | 1.8 | 2.3 |
| local planarity LSH(nm) | 123 | 67 | 73 | 77 |
| scratch count/wafer | 2,136 | 523 | 254 | 117 |

| | Ex. 5 | Ex. 6 | Ex. 7 | Ex. 8 |
|---|---|---|---|---|
| hardness (Shore D) | 42 | 63 | 80 | 63 |
| hardness (Shore D) after 24 hours of immersion in deionized water at 23° C. | 41 | 62 | 77 | 62 |
| <storage elastic modulus E'> | | | | |
| 30° C. E' | 45 | 210 | 1351 | 199 |
| 60° C. E' | 16 | 66 | 355 | 64 |
| 90° C. E' | 9 | 40 | 252 | 38 |
| ratio of E' at 30° C. to E' at 60° C. | 2.8 | 3.2 | 3.8 | 3.1 |
| ratio of E' at 30° C. to E' at 90° C. | 5.0 | 5.3 | 5.4 | 5.2 |
| <evaluation of polishing performance> | | | | |
| removal rate (nm/min) | 236 | 204 | 255 | 188 |
| the with-in wafer non-uniformity (WIWNU) of removal rate (%) | 3.2 | 2.2 | 3.6 | 4.1 |
| local planarity LSH(nm) | 126 | 58 | 105 | 57 |
| scratch count/wafer | 56 | 852 | 139 | 2,035 |

| | Ex. 9 | Ex. 10 | C. Ex. 1 | C. Ex. 2 |
|---|---|---|---|---|
| amount (wt %) of chain extender having a number average molecular weight of 300 or less | (100%) | (52.4%) | (52.4%) | (47.6%) |
| amount (wt %) of trifunctional chain extender | (35.6%) | (26.2%) | (14.3%) | (26.2%) |
| number average molecular weight of chain extender B | (175.4) | (287.6) | (325.7) | (312.9) |
| ratio of number average molecular weight of Y to number average molecular weight of B | (4.84) | (1.66) | (1.46) | (1.52) |
| <water-soluble particles C> | | | | |
| β-cyclodextrin (average particle diameter of 20 μm) | 389.1 | 14.4 | 14.4 | 14.4 |
| γ-aminopropyltriethoxysilane A1100 | 1.945 | 0.072 | 0.072 | 0.072 |
| β-cyclodextrin treated with silane coupling agent | 391 | 14.5 | 14.5 | 14.5 |
| amount (vol %) of water-soluble particles | (75.0%) | (10.0%) | (10.0%) | (10.0%) |
| <molding conditions> | | | | |
| conditions before removing from mold | 110° C. * 30 min. | 110° C. * 30 min. | 110° C. * 30 min. | 110° C. * 30 min. |
| post-curing conditions | 110° C. * 16 hr. | 110° C. * 16 hr. | 110° C. * 16 hr. | 110° C. * 16 hr. |

| | C. Ex. 3 | C. Ex. 4 | C. Ex. 5 | C. Ex. 6 |
|---|---|---|---|---|
| amount (wt %) of chain extender having a number average molecular weight of 300 or less | (0%) | (100%) | (100%) | |
| amount (wt %) of trifunctional chain extender | (43.1%) | (16.5%) | (0%) | |
| number average molecular weight of chain extender B | (512.0) | (120.8) | (267.2) | |
| ratio of number average molecular weight of Y to number average molecular weight of B | (0.49) | unknown | unknown | |
| <water-soluble particles C> | | | | |
| β-cyclodextrin (average particle diameter of 20 μm) | 14.5 | 2.5 | — | |
| γ-aminopropyltriethoxysilane A1100 | — | — | — | |
| β-cyclodextrin treated with silane coupling agent | — | — | — | |
| amount (vol %) of water-soluble particles | (10.0%) | (1.9%) | — | |
| <molding conditions> | | | | |
| conditions before removing from mold | 80° C. * 20 min. | 80° C. * 20 min. | 100° C. * 60 min. | |
| post-curing conditions | 110° C. * 5 hr. | 110° C. * 5 hr. | 100° C. * 16 hr. | |

| | Ex. 9 | Ex. 10 | C. Ex. 1 | C. Ex. 2 |
|---|---|---|---|---|
| hardness (Shore D) | 82 | 74 | 69 | 71 |
| hardness (Shore D) after 24 hours of immersion in deionized water at 23° C. | 74 | 71 | 67 | 62 |

TABLE 1-continued

| | | | | |
|---|---|---|---|---|
| <storage elastic modulus E'> | | | | |
| 30° C. E' | 1689 | 724 | 425 | 598 |
| 60° C. E' | 428 | 98 | 248 | 32 |
| 90° C. E' | 325 | 66 | 118 | 20 |
| ratio of E' at 30° C. to E' at 60° C. | 3.9 | 7.4 | 1.7 | 18.7 |
| ratio of E' at 30° C. to E' at 90° C. | 5.2 | 11.0 | 3.6 | 29.9 |
| <evaluation of polishing performance> | | | | |
| removal rate (nm/min) | 253 | 217 | 219 | 216 |
| the with-in wafer non-uniformity (WIWNU) of removal rate (%) | 7.7 | 2.6 | 5.6 | 11.2 |
| local planarity LSH(nm) | 147 | 103 | 162 | 181 |
| scratch count/wafer | 2,123 | 384 | 6,874 | 326 |

| | C. Ex. 3 | C. Ex. 4 | C. Ex. 5 | C. Ex. 6 |
|---|---|---|---|---|
| hardness (Shore D) | 83 | 65 | 73 | 55 |
| hardness (Shore D) after 24 hours of immersion in deionized water at 23° C. | 59 | 62 | 71 | 53 |
| <storage elastic modulus E'> | | | | |
| 30° C. E' | 1300 | 274 | 694 | 709 |
| 60° C. E' | 13 | 213 | 375 | 431 |
| 90° C. E' | 11 | 178 | 258 | 228 |
| ratio of E' at 30° C. to E' at 60° C. | 100.0 | 1.3 | 1.9 | 1.6 |
| ratio of E' at 30° C. to E' at 90° C. | 118.2 | 1.5 | 2.7 | 3.1 |
| <evaluation of polishing performance> | | | | |
| removal rate (nm/min) | 175 | 209 | 142 | 213 |
| the with-in wafer non-uniformity (WIWNU) of removal rate (%) | 13.5 | 9.6 | 12.1 | 3.8 |
| local planarity(nm) | 98 | 93 | 86 | 126 |
| scratch count/wafer | 126 | 7,972 | 35,489 | 23,862 |

Ex.: Example
C.Ex.: Comparative Example

In Comparative Example 1 in which the content of a trifunctional component in the chain extender is lower than 20%, as a change in storage elastic modulus by temperature is small and the ability of easing stress generated by foreign matter is low, a large number of scratches are produced. The pad of Comparative Example 1 is slightly inferior in planarity. In Comparative Example 2 in which the content of a component having a number average molecular weight of 300 or less in the chain extender is lower than 50 wt %, as a change in storage elastic modulus by temperature is too large, the obtained polishing pad is inferior in planarity and in-plane uniformity. In Comparative Example 3 in which a component having a number average molecular weight of 300 or less is not contained in the chain extender, as the phase separation of the polyurethane matrix is incomplete, a change in hardness at the time of immersion in water is large and there is a problem with the actual use of the obtained pad. In Comparative Example 4 in which the content of a trifunctional component in the chain extender is lower than 20%, as a change in storage elastic modulus by temperature is small and the ability of easing stress generated by foreign matter is low, a large number of scratches are produced. In Comparative Example 5 in which a trifunctional component is not contained in the chain extender, a large number of scratches are produced. In Comparative Example 6 which is a commercially available foamed polyurethane polishing pad, a change in storage elastic modulus by temperature is small and a huge number of scratches are produced. In contrast to these, the polishing pads of Examples 1 to 10 of the present invention have good physical properties and good balance among properties. Therefore, these polishing pads can be advantageously used to polish the surface of a semiconductor wafer or the like.

What is claimed is:

1. A polishing pad having a polishing layer made of a polyurethane or polyurethane-urea, wherein the polyurethane or polyurethane-urea comprises a cured reaction product of a mixture of an isocyanate-terminated urethane prepolymer A and a chain extender B which has two or more active hydrogen-containing groups capable of reacting with an isocyanate group in the molecule and satisfies the following conditions "a" and "b":

a. the chain extender consists of 50 to 100 wt % of a chain extender having a number average molecular weight of 300 or less and 50 to 0 wt % of a chain extender having a number average molecular weight higher than 300, b. the chain extender consists of 20 to 100 wt % of a chain extender having three or more active hydrogen-containing groups in the molecule and 80 to 0 wt % of a chain extender having two active hydrogen-containing groups in the molecule; and the ratio of the storage elastic modulus at 30° C. to the storage elastic modulus at 60° C. of said polishing layer is 2 to 15, and the ratio of the storage elastic modulus at 30° C. to the storage elastic modulus at 90° C. of said polishing layer is 4 to 20.

2. The polishing pad according to claim 1, wherein the isocyanate-terminated urethane prepolymer A is obtained by reacting a polyisocyanate with a compound Y having two or more OH groups in the molecule and a number average molecular weight of 300 to 2,000 in an isocyanate group/OH group equivalent ratio of 2 or more.

3. The polishing pad according to claim 2, wherein the chain extender B contains 50 to 100 wt % of a chain extender having a number average molecular weight of 250 or less and 30 to 100 wt % of a chain extender having three or more active hydrogen-containing groups in the molecule, the number average molecular weight of the compound Y having two or more OH groups in the molecule used for the manufacture of the isocyanate-terminated urethane prepolymer A is 400 to 1,500, and the ratio of the number average molecular weight of the compound Y having two or more OH groups in the molecule to the number average molecular weight of the chain extender B is 3 or more.

4. The polishing pad according to any one of claims 1 to 3, wherein the chain extender B is a polyol and/or a polyamine.

5. The polishing pad according to any one of claims 1 to 3, wherein the chain extender B is a polyol.

6. The polishing pad according to claim 1, wherein the ratio of the storage elastic modulus at 30° C. to the storage elastic modulus at 60° C. is 3 to 10.

7. The polishing pad according to claim 1, wherein the ratio of the storage elastic modulus at 30° C. to the storage elastic modulus at 90° C. is 5 to 15.

8. The polishing pad according to claim 1, wherein water-soluble particles are dispersed in the polishing layer made of a polyurethane or polyurethane-urea in an amount of 0.5 to 70 vol % based on 100 vol % of the polishing layer.

9. The polishing pad according to claim 8, wherein the polishing layer is obtained by dispersing the water-soluble particles in the isocyanate-terminated urethane prepolymer A and/or the chain extender B in advance, mixing together all the raw materials and curing the resulting mixture.

10. The polishing pad according to claim 8, wherein the polishing layer is obtained by dispersing the water-soluble particles in the isocyanate-terminated urethane prepolymer A, mixing the chain extender B with the dispersion and curing the resulting mixture.

11. The polishing pad according to any one of claims 8 to 10, wherein the water-soluble particles have been treated with a coupling agent having at least one functional group selected from the group consisting of an amino group, epoxy group and oxazoline group.

* * * * *